US005758247A

United States Patent [19]

Yanashima et al.

[11] Patent Number: 5,758,247

[45] Date of Patent: May 26, 1998

[54] CHARGE REMOVING DEVICE FOR ELECTROPHOTOGRAPHIC PRINTER

[75] Inventors: Tsukasa Yanashima; Hiroyuki Saito; Hiroyuki Yamaguchi, all of Tokyo, Japan

[73] Assignee: Asahi Kogaku Kogyo Kabushiki Kaisha, Tokyo, Japan

[21] Appl. No.: 618,804

[22] Filed: Mar. 20, 1996

[30] Foreign Application Priority Data

Mar. 24, 1995 [JP] Japan ..... 7-091675

[51] Int. Cl.[6] ..... G03G 21/00

[52] U.S. Cl. ..... 399/384; 399/315; 399/317; 399/390

[58] Field of Search ..... 399/315, 316, 399/317, 384, 390; 361/212, 214

[56] References Cited

U.S. PATENT DOCUMENTS

| | | | |
|---|---|---|---|
| 3,850,519 | 11/1974 | Weikel, Jr. | 361/214 X |
| 4,933,723 | 6/1990 | Kakuta et al. | 399/316 |
| 5,043,759 | 8/1991 | Sakai | 361/212 X |
| 5,101,239 | 3/1992 | Nishikawa et al. | 399/311 |
| 5,105,227 | 4/1992 | Kitamura et al. | 399/317 |
| 5,113,228 | 5/1992 | Monma et al. | 399/317 |
| 5,220,396 | 6/1993 | Monma et al. | 399/121 |
| 5,285,239 | 2/1994 | Negoro | 399/349 |
| 5,317,371 | 5/1994 | Monma et al. | 399/317 |
| 5,432,593 | 7/1995 | Nishikawa et al. | 399/384 X |
| 5,592,278 | 1/1997 | Sato et al. | 399/384 |

FOREIGN PATENT DOCUMENTS

| | | |
|---|---|---|
| 58-75166 | 5/1983 | Japan . |
| 1-154074 | 6/1989 | Japan . |
| 1-312570 | 12/1989 | Japan . |

*Primary Examiner*—Arthur T. Grimley
*Assistant Examiner*—Sophia S. Chen
*Attorney, Agent, or Firm*—Greenblum & Bernstein P.L.C.

[57] ABSTRACT

A charge removing member is arranged just upstream of an image transfer area along a continuous form transport path, between the last guiding portion and the transfer area, to remove accumulated charge on the continuous form. The charge removing member is alternatively a brush contactable to the form, a non-contact conductive member, a brush movable toward and away from the form, or a brush that acts as a guide member. Further alternatively, the brush contacts the form only during reverse feeding of the form, and in this case, is alternatively movable toward and away from the form, movable toward and away from the form in association with a transfer unit, or positioned to contact a straight form while being out of contact with a form bent by a transfer unit.

14 Claims, 7 Drawing Sheets

CHARGE REMOVING DEVICE FOR ELECTROPHOTOGRAPHIC PRINTER

BACKGROUND OF THE INVENTION

The present invention relates to a charge removing device in an electrophotographic printer, and more particularly, to a device for removing charge on a continuous form sheet.

Conventionally, in a continuous form electrophotographic printer, a toner image is adhered by electrostatic force to a photoconductive drum. The toner image is then transferred, at a transfer station, to the continuous form as the form advances along a transport path. The transferred toner image carried by the continuous form is then fused by heat and pressure by a fixing device positioned further downstream along the transport path.

A blank portion of the form, corresponding to the distance between the transfer station and the fixing device, follows the last transferred toner image portion downstream to the fixing device. In order to improve the functionality of such a printer, the blank portion is retracted back along the transport path after the last transferred image is fixed, such that a successive image may be transferred to the form without wasting paper.

This blank portion is heated and thereby dried by the heat roller at the fixing station. The continuous form becomes susceptible to acquiring undesired charge by contacting the feeding guides, especially in low humidity. When the blank portion is retracted and then fed in the forward direction, the form contacts various guides along the sheet feeding path, in both directions. By this contact, the form can acquire an undesired charge, which can cause improper image transfer.

SUMMARY OF THE INVENTION

It is therefore an object of the present invention to provide an improved charge removing device in an electrophotographic printer capable of preventing undesired charging of a continuous form.

In order to meet the objects of the invention, a charge removing device for a continuous form electrophotographic printer is provided and includes an image transfer device for electrostatically transferring a toner image formed on a photoconductive member onto the continuous form. A fixing device for fixing the toner image onto the continuous form, a feeding mechanism for feeding the continuous form along a transport path, and a charge removing device for removing charges accumulated on the continuous form. The charge removing device is arranged along the transport path upstream of an image transfer area in which the toner image is transferred to the continuous form by the transfer device. In this manner, any charge accumulated by the continuous form, whether it be generated by friction or otherwise, is removed upstream of the image transfer. The quality of printing is improved thereby, in that no undesired charge remains on the form at the time of image transfer.

The feeding mechanism may feed the continuous form in forward and reverse directions. In such a case, the charge is still removed by the charge removing device upstream of image transfer.

According to one aspect of the present invention, the charge removing device removes charges by contacting the continuous form. In this case, the charge removing device preferably includes a charge removing brush consisting of a plurality of electrically conductive brushes contacting a surface of the continuous form, and arranged across the entire width of the continuous form. Accordingly, any charge is removed by the contact of the brush with the continuous form.

Preferably, the continuous form proceeds along the transport path directly from the charge removing device to the transfer area without contacting any member after charges are removed. Accordingly, no member is available to transmit any charge (by friction or otherwise) to the form between the charge removal and image transfer.

In one development of the invention, the charge removing brush includes a guide mechanism for leading the continuous form to the image transfer device, and wherein the charge removing brush is arranged at an opposing side of the image transfer device with respect to the fixing device. Accordingly, the charge removing brush itself acts to guide the continuous form into the image transfer area, reducing the number of parts yet operating to remove the charge upstream of image transfer.

In another development of the invention, the device includes a guide member for leading the continuous form to the image transfer device, on an opposing side of the image transfer device with respect to the fixing device. The charge removing brush is fixed to an upstream side along the transport path of the guide member, and a front end of the charge removing brush contacts the continuous form at a peak of the guide member. Accordingly, the brush removes the charge upstream of image transfer, and is supported by the guide member in the correct position.

In this case, the guide member is formed of an electrically conductive material and is grounded, so that the charge removing brush is similarly easily grounded.

According to a preferred embodiment of the present invention, the charge removing brush removes charges on the continuous form only when the continuous form is fed in a reverse direction. Firstly, the form is heated and dried at the fixing means, and tends to be moved quickly over at least a page length in the reverse direction, increasing the likelihood that undesired charge will be generated. Secondly, it is desirable to prevent the generation of paper dust. In both these cases, it is advantageous to remove charges only when the form is moved in the reverse direction. In one case, the continuous form is always heated by passing through said fixing means before being fed in a reverse direction.

Preferably, the charge removing brush is movable relative to the continuous form and is arranged on the upstream side of the image transfer device along the transport path. Further preferably, the charge removing brush removes charges by contacting a surface of the continuous form on a printed side of the continuous form.

In another preferred embodiment, the device includes a brush moving mechanism for moving the charge removing brush and contacting the charge removing brush to the continuous form when the continuous form is fed in a reverse direction, and for retracting the brush away from the continuous form when the continuous form is fed in a forward direction. The charge removing brush thereby removes undesired charge and is retraced away from the form at appropriate times.

In one particular development of this embodiment, the device includes a swinging mechanism for swinging the image transfer device toward and away from the continuous form about a pivot, and a form contacting member provided to the transfer device for bending the continuous form away from the charge removing brush when the continuous form is fed in a reverse direction, and for allowing the continuous form to move toward and contact the charge removing brush when the continuous form is fed in a forward direction.

In another particular development of this embodiment, a swinging mechanism swings the transfer means toward and away from the continuous form, the brush moving mechanism moves the charge removing brush in cooperation with the swinging mechanism. In this case, the brush moving mechanism preferably includes a brush swinging mechanism for swinging the charge removing brush toward and away from the continuous form. Further preferably, the swinging mechanism for swinging the transfer device is provided with a pivot upstream of the transfer device, about which the transfer device is swung.

According to another aspect of the invention, the charge removing device removes charges without contacting the continuous form. In this case, the charge removing device preferably includes a conductor, substantially perpendicular to a surface of the continuous form and extending along the width direction of the continuous form. Preferably, the conductor is grounded, and sufficiently close to the continuous form to discharge the continuous form without contacting the continuous form In a particularly favorable development, the conductor includes a plate having triangular saw-like protrusions extending toward the form, and distributed along the width direction of the continuous form.

DETAILED DESCRIPTION OF THE PREFERRED EMBODIMENTS

Figure 1:
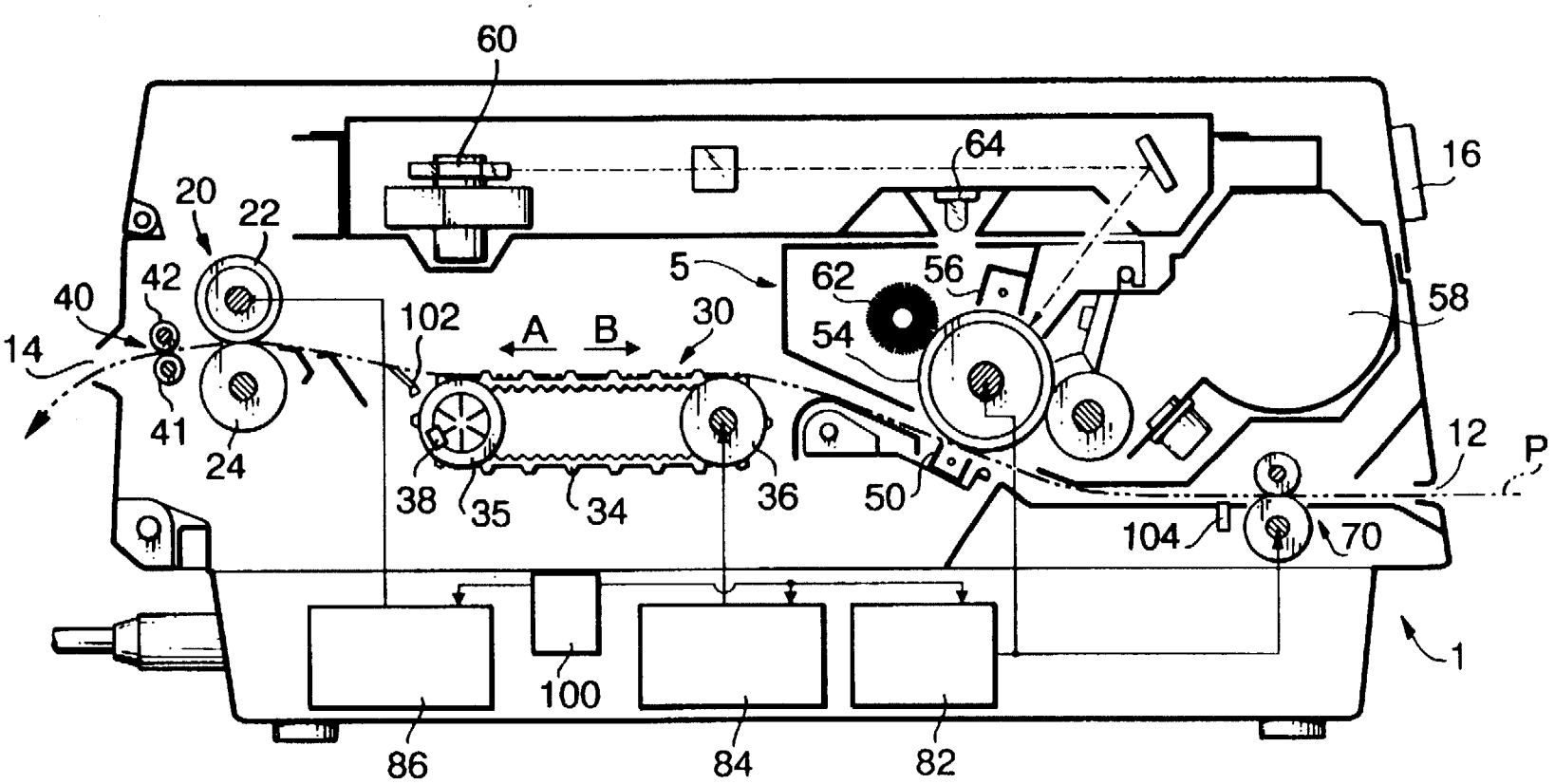
FIG. 1 is a side schematic view showing an electrophotographic printer to which an embodiment of the present invention is applied.

FIG. 1 is a side schematic view showing an electrophotographic printer in which the embodiments of the invention are employed. A continuous form P, having feeding holes along both lateral sides of the form, and perforations for separating discrete pages of the form, is employed as a recording sheet in the electrophotographic printer 1. The continuous form P is transferred along a transport path between a sheet inlet 12 and a sheet outlet 14.

The electrophotographic process is carried out by a process unit 5 including a photoconductive drum 54, a developing unit 58, a cleaning brush 62, a discharging lamp 64, and a charging station 56. A laser scanning unit 60 and a transfer unit 50 also participate in the electrophotographic process.

Along the transport path from the inlet 12, the transfer unit 50 for transferring a toner image onto the form P, a tractor unit 30 for regulating the feed of the form P, a fixing unit 20 for fusing the toner image onto the form P, and a discharge roller pair 40 for discharging the form P from the printer 1, are arranged in that order. The transfer of the image from the drum 54 to the form P takes place at the transfer unit 50, the vicinity of which is hereinafter referred to as an "image transfer areas".

A back tension roller pair 70 is provided in the vicinity of the inlet 12 for applying tension to the form P. During the feeding of the continuous form P, the back tension roller pair 70 is always rotated to urge the form P in the reverse direction to maintain tension. When the form P is fed in a forward direction, the back tension roller pair 70 slips on the surface of the continuous form P to apply a tension thereto. When the continuous form P is fed in a reverse direction, the back tension roller pair 70 feeds the paper in the reverse direction in cooperation with the tractor unit 30. A paper input sensor 104 is provided in the vicinity of the back tension roller 70 to detect a continuous form P.

A laser beam modulated in accordance with an image signal is projected from the laser scanning unit 60 (scanning in a main scanning direction), and is directed to the rotating (subscanning) photoconductive drum 54. The photoconductive drum 54 is driven at a constant speed via a gear train (not shown) by a motor 82. The photoconductive surface of the drum 54 is uniformly charged at the charging station 56, and when the surface is exposed to the laser beam, a latent image is formed thereon. Toner is adhered to the latent image by a developing unit 58 to form a toner image. The toner image is transferred onto the recording sheet (form P) at the transfer unit 50. The form bearing the toner image is transported downstream, and is fixed by a fixing unit 20, completing the printing for that image.

Any toner remaining on the surface of the drum 54 (after transfer of the toner image to the form P) is removed by the cleaning brush 62. Furthermore, any remaining charge on the surface of the photoconductive drum 54 is discharged at the discharging lamp 64 in preparation for the next image formation.

The tractor unit 30 is provided with a front pulley 35, a drive pulley 36, and an endless tractor belt 34 (having tractor pins for engaging the feeding holes of the form P). A belt 34 and pulleys 35, 36 are provided on each lateral side of the transport path. The drive pulley 36 is driven by a stepping motor 84 via a gear train (not shown), and is drivable in both forward (arrow A in FIG. 1) and reverse (arrow B in FIG. 1) directions. An encoder 38 is linked to the front pulley 35 of the tractor 30 for outputting a paper feed signal (PFS) according to the rotation of the front pulley 35.

The fixing unit 20 comprises a heat roller 22 and a pressure roller 24, and the discharge roller pair 40 comprises an upper roller 42 and a lower roller 41. The heat roller 22 and lower discharge roller 41 are driven by a motor 86 via a gear train (not shown). The pressure roller 24 and upper discharge roller 42 are retractable by a retracting mechanism (not shown) from an operating position to a retracted position. In the operating position, the pressure roller 24 presses the form P against the heat roller 22 and the upper discharge roller 42 presses the form P against the lower discharge roller 41. In the retracted position, the pressure roller 24 and upper discharge roller 42 are moved away from their respective facing rollers and away from contact with the form P.

Figure 2:
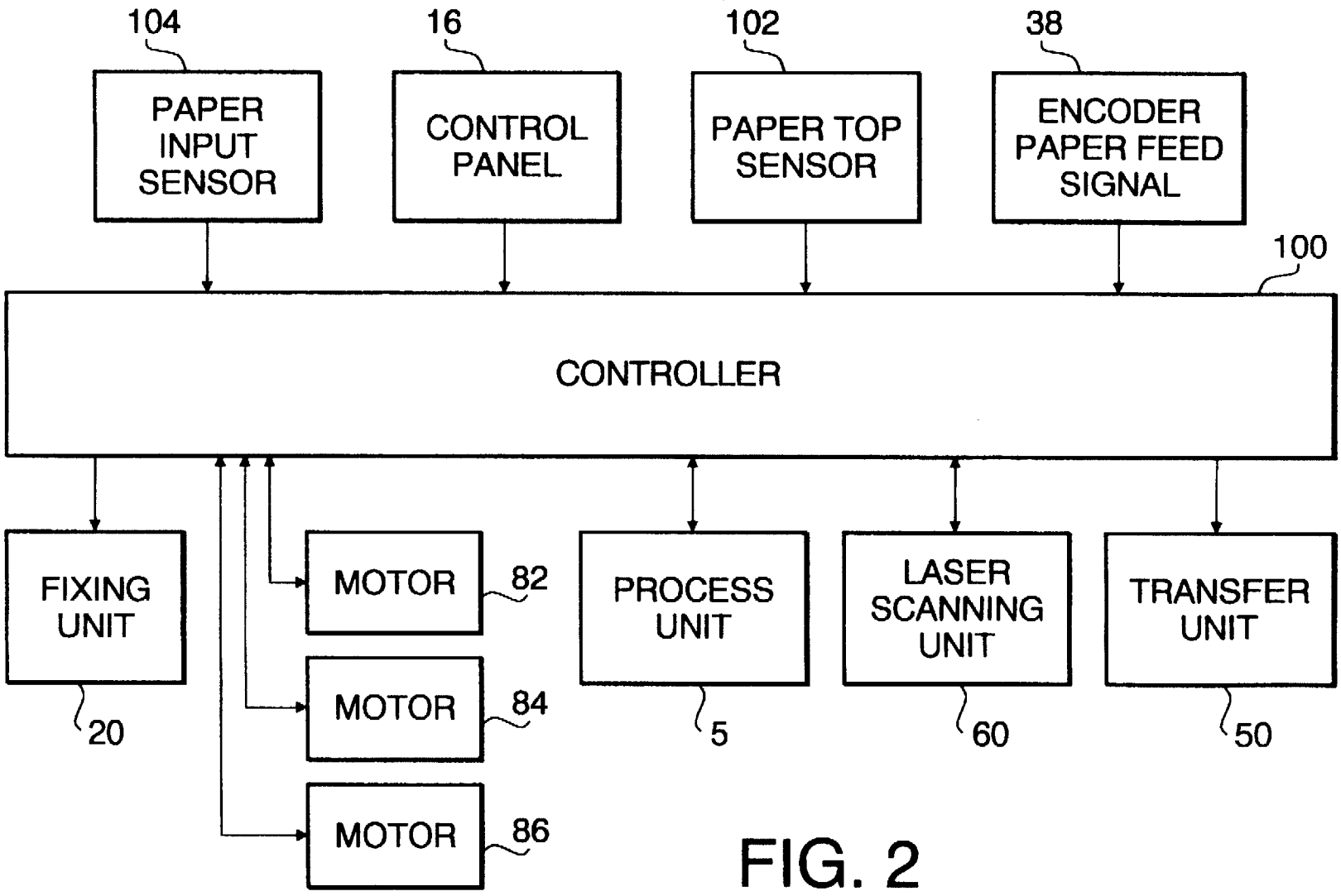
FIG. 2 is a block diagram representing the control system of the electrophotographic printer.

FIG. 2 is a block diagram detailing the control system of the printer 1. Inputs to the controller 100 include detection signals from a paper top sensor 102 (shown in FIG. 1), a paper input sensor 104, the paper feed signal PFS (generated by the encoder 38), and a control panel 16 provided on the exterior of the printer 1. The controller 100 controls motors 82, 84, and 86. The controller also controls the fixing unit 20 and the transfer unit 50. Further, the controller 100 controls the elements of the electrophotographic process, including the laser scanning unit 60 and the process unit 5.

In operation, after a toner image is advanced along the transport path and is fixed at the fixing unit 20, the controller 100 reverses paper transport in order to avoid paper wastage. Specifically, when printing of a page is completed, the tractor unit 30 and the discharge roller pair 40 feed the continuous form P in the forward direction, and stop the form P at a predetermined position where the trailing perforations of the last printed page are discharged from the printer at the outlet 14, to allow the user to view or separate the last printed page. The controller 100 detects the predetermined stopping position according to a paper feed signal (PFS) generated by the encoder 38.

At this time, an unprinted portion of the form P remains downstream of the image transfer area. However, by reversing the paper transport such that the unprinted portion of the continuous form P is brought upstream of the image transfer area, the unprinted portion is available for printing. In order to reverse the paper transport after the printed pages of the form P are discharged from the printer, the pulley 36 is rotated in a reverse direction to feed the form P in a reverse direction.

The retracting operation of the continuous form P differs when the last printed page is separated and when it is not. For example, if the last printed page is not separated from the form P, the form P is retracted until trailing perforations of the last printed page are upstream of the image transfer area, and the next printing operation is resumed at this point to print a succeeding image on the page next to the last printed page. Specifically, a paper feed signal (PFS) counter C (not shown) for determining the page position is monitored with reference to a count position target P1. The value P1 represents the distance from (i) the position to which the trailing edge of the last printed page was advanced, to (ii) the position near the image transfer area at which the printing process is started for each page. When the PFS counter C, counting as the form is reversely fed, reaches P1 with the top sensor (PTS) 102 continuously ON, the last printed page of the continuous form was therefore unseparated, and the page succeeding the last printed page is used as the first page to print the image thereon. In this case, when the PFS counter reaches P1, the motor 84 is stopped to stop the reversal of the continuous form P along the transport path. Subsequently, the continuous form P is again fed in the forward feeding direction upon the resumption of printing operations.

Otherwise, the separation of a last printed page is detected when the paper top sensor 102 is turned from ON to OFF before the PFS count C reaches P1. That is, the leading end of the remaining form P is, retracted until it is detected by the paper top sensor 102 before the next printing operation is performed. In this case, the motor 84 is stopped, and then rotates to feed the continuous form P in the forward direction, and is driven until the leading edge of the continuous form P is inserted between the discharge roller pair 40. At this time, the page positioned upstream of the transfer area is used as the next page to print an image.

Each embodiment of the invention shares the previously described portions of an electrophotographic printer 1. Distinctive features of each embodiment are described hereinafter.

Figure 3:
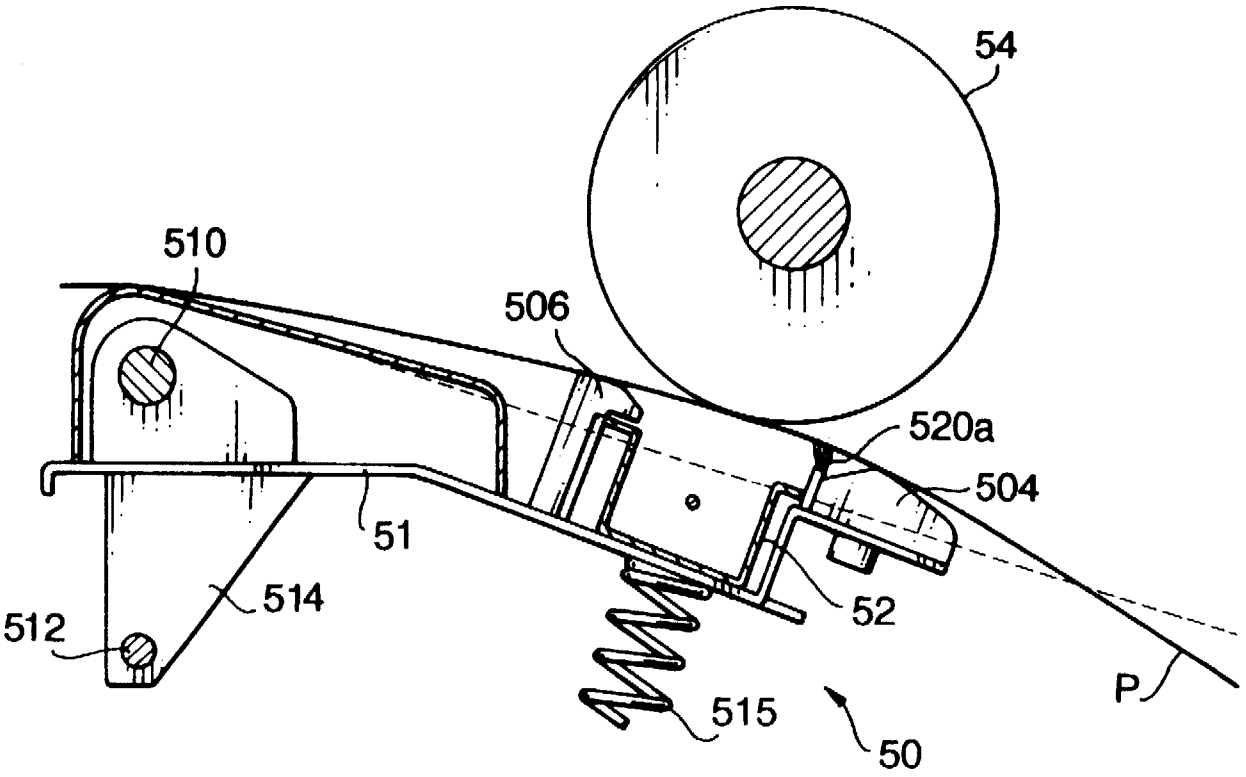
FIG. 3 is a side schematic view of an image transfer area.

FIG. 3 is a side view showing a raising mechanism for transfer unit 50 of the printer 1, and a first embodiment of the invention. In the transfer unit 50, a corona charger 52, an upstream side guide 504, and a downstream side guide 506 are provided on a swinging member 51 swingable about a pivot shaft 510. The guides 504 and 506 are provided to ensure contact of the continuous form P with the drum 54 during image transfer. During image transfer, the transfer unit 50 is positioned at an operating position (as illustrated in FIG. 3), and a plane connecting the upper tips of the upstream guide 504 and downstream guide 506 intersects the surface of the photoconductive drum 54. When the continuous form P, is being retracted along the transport path, the transfer unit 50 is swung downwardly away from the drum 54 and out of contact with the form P, as indicated in FIG. 3 by a dashed line representing the form P, during retraction along the transport path.

A compression spring 515 and a rotator arm 514 having a boss 512 are provided at the lower portion of the swinging member 51. To retract the transfer unit 50, the boss 512 is moved by a contacting mechanism (not shown) to swing the swinging member 51 about the pivot 510, compressing the spring 515. During printing, the boss 512 is released, allowing the swinging member 51 and transfer unit 50 to move up to the operating position under the bias of the spring 515.

A charge removing brush 520*a* is arranged between the upstream side guide 504 and the drum 54, to remove charge on the continuous form P upstream of the image transfer. Although the generation of undesired electric charge is aggravated by the reverse feeding of the form P along the transport path, electric charge on the continuous form P may occur even if a printer does not reverse the continuous form P. In either case, low humidity increases the likelihood that undesired charges are generated by the feeding of the form P along the transport path. Therefore, in order to ensure the removal of charge from the form P before image transfer, the charge removing brush 520*a* is arranged near the transfer unit 50, downstream of the last member that contacts the continuous form before the image transfer (that is, upstream side guide 504).

Figure 4:
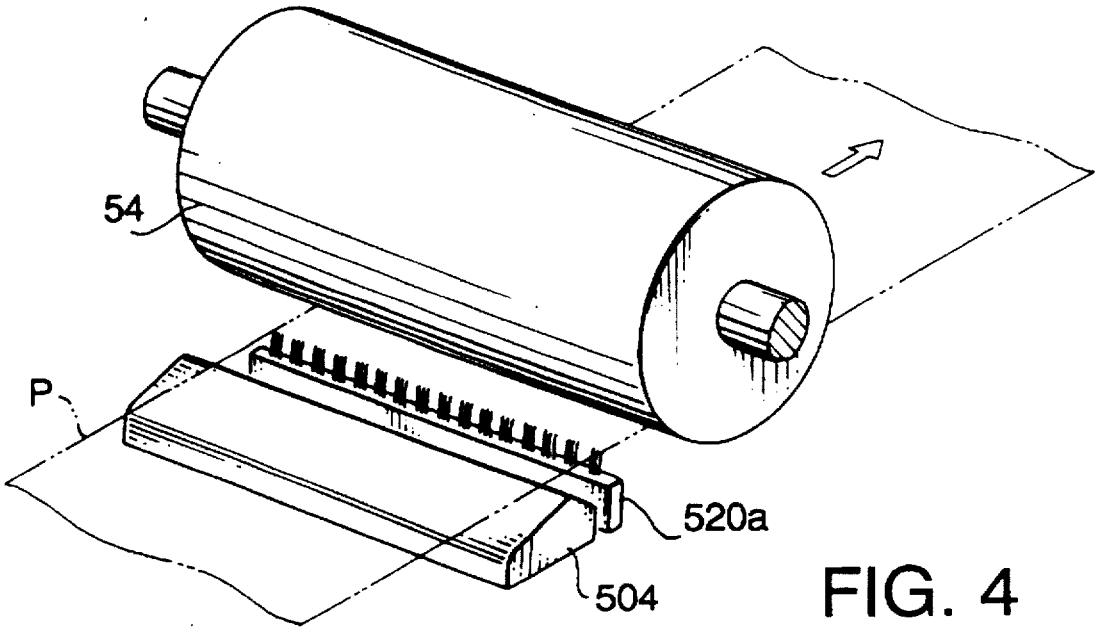
FIG. 4 is a perspective view of an image transfer area, showing a first embodiment of the invention.

FIG. 4 is a perspective view showing the charge removing brush 520*a* according to the first embodiment of the invention. The charge removing brush 520*a* is arranged between the upstream side guide 504 and the contact point of the form P to the drum 54 as previously described. The brush end of the charge removing brush 520*a* contacts the lower side of the continuous form P over the entire width of the form P. The charge removing brush 520*a* is electrically conductive and grounded. The brush 520*a* does not generate any static electric charge on the form P due to friction, but rather removes any charge on the form P. Even when the continuous form P is charged due to contact with the upstream side guide 504, the charge removing brush 520*a* contacts the rear surface of the form P and discharges the form P.

Portions of the following embodiments common to the first embodiment and having the same function as those of the first embodiment are hereinafter designated with the same reference numerals as those used in the description of the first embodiment.

Figure 5:
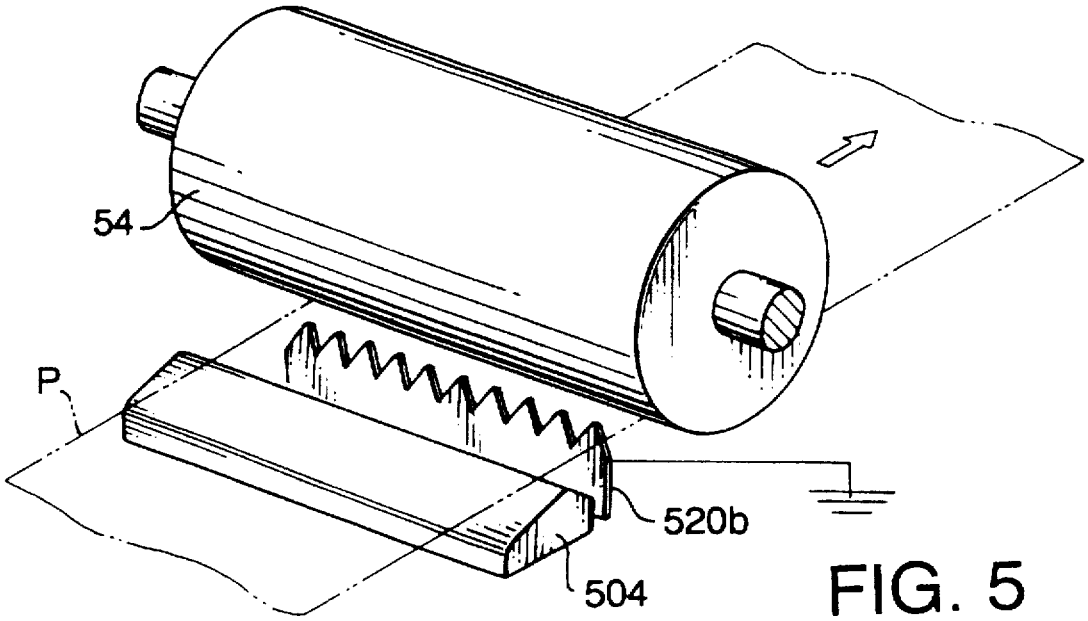
FIG. 5 is a perspective view of an image transfer area, showing a second embodiment of the invention.

FIG. 5 shows a second embodiment of a charge removing device according to the invention. As shown in FIG. 5, a non-contact charge removing conductor 520*b* is placed between the upstream side guide 504 and the drum 54. The charge removing conductor 520*b* is formed as a thin plate having triangular protrusions along its entire length. In this embodiment, triangular protrusions having a height of 3 mm are formed at 2 mm intervals. The charge removing conductor 520*b* is spaced from the continuous form P by a predetermined distance when the transfer station is in its operating position. In this embodiment, the clearance between the continuous form P and the tips of the protrusions of the charge removing conductor is approximately 1 mm. When the continuous form P is charged due to contact with the upstream side guide 504, the charge removing conductor 520*b* discharges the form.

Figure 6:
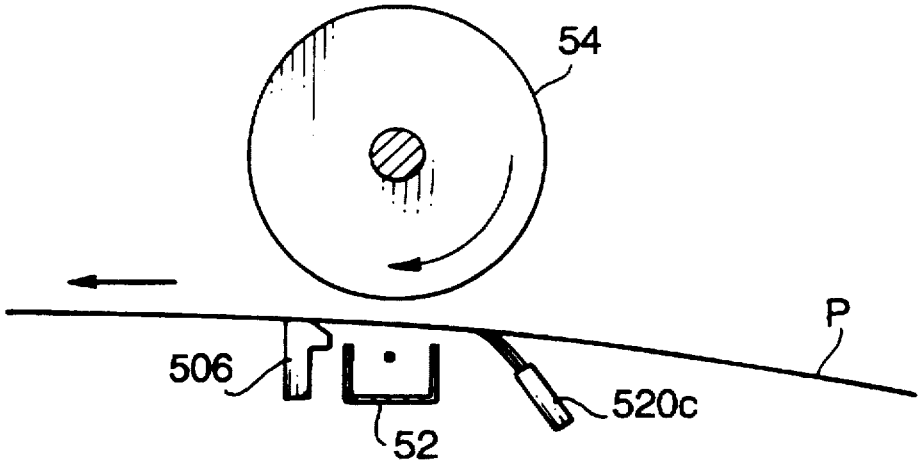
FIG. 6 is a side schematic view of an image transfer area, showing a third embodiment of the invention.

FIG. 6 is a side schematic view showing a third embodiment of a charge removing device according to the invention. As shown in FIG. 6, a charge removing brush 520*c* replaces the upstream side guide described previously. In this embodiment, the charge removing brush 520*c* guides the feeding of the continuous form P on the upstream side of the image transfer unit 50, and also removes any undesired charges thereon by contacting the bottom surface of the form P. In addition to preventing the charging of the form P during image transfer, the number of parts required is reduced.

Figure 7:
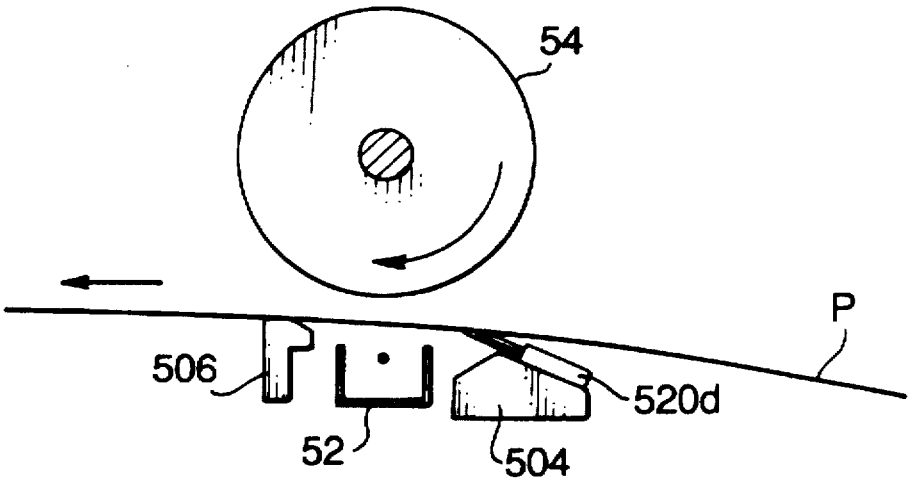
FIG. 7 is a side schematic view of an image transfer area, showing a fourth embodiment of the invention.

FIG. 7 is a side view showing a fourth embodiment of a charge removing device according to the invention. As shown in FIG. 7, a charge removing brush 520*d* is fixed to the upstream side guide 504 (by a screw, spot-weld, or the like) such that the front end of the charge removing brush 520*d* is positioned at the peak portion of the upstream side guide 504. In this case, the upstream side guide 504 is preferably made of metal or electrically conductive resin, and is grounded, thereby grounding the brush 520*d*. The continuous form P is slightly raised by the brush 520*d*, and does not contact the upstream side guide 504 prior to reaching the image transfer station. Further, in case the continuous form P is charged due to contact with guides other than the upstream side guide 504, the charge can be removed by means of the charge removing brush 520*d*.

Figure 8A:
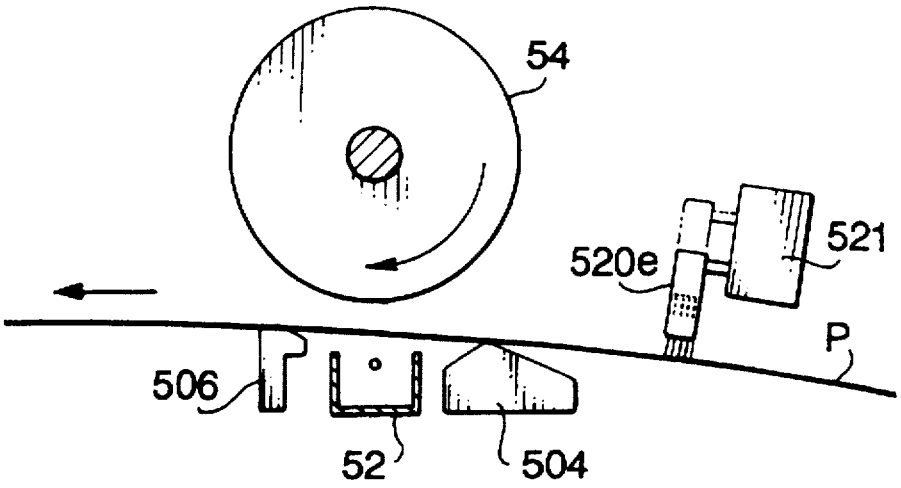
FIG. 8A is a side schematic view of an image transfer area, showing a fifth embodiment of the invention.

FIG. 8A shows a fifth embodiment of a charge removing device according to the invention, employing a charge removing brush 520*e* and a brush moving mechanism 521. As shown in FIG. 8A, the charge removing brush 520*e* can be moved between an operating position, contacting the printing surface of the continuous form P, and a retracted position, spaced apart from the printing surface of the form P by a predetermined distance. The charge removing brush is moved by a brush moving mechanism 521 that moves opposite to the retracting mechanism of the transfer station under the control of the controller 100. Alternatively, the brush moving mechanism is mechanically linked to the transfer unit 50 to move in an opposite direction.

That is, as shown in FIG. 8A, when the form P is being transported in the reverse direction along the sheet transport path, the transfer unit 50 is retracted from the form P and the charge removing brush 520*e* (shown by a dashed line in this position in FIG. 8A) moves to contact the form P. When the form P is being transported in the forward direction along the sheet transport path, the transfer unit 50 is moved to contact the form P while the charge removing brush 520*e* (shown by a solid line in this position in FIG. 8A) is retracted away from the form P. Thus, the brush 520*g* only contacts the continuous form P and removes charge when the continuous form P is being fed in a reverse direction.

Figure 8B:
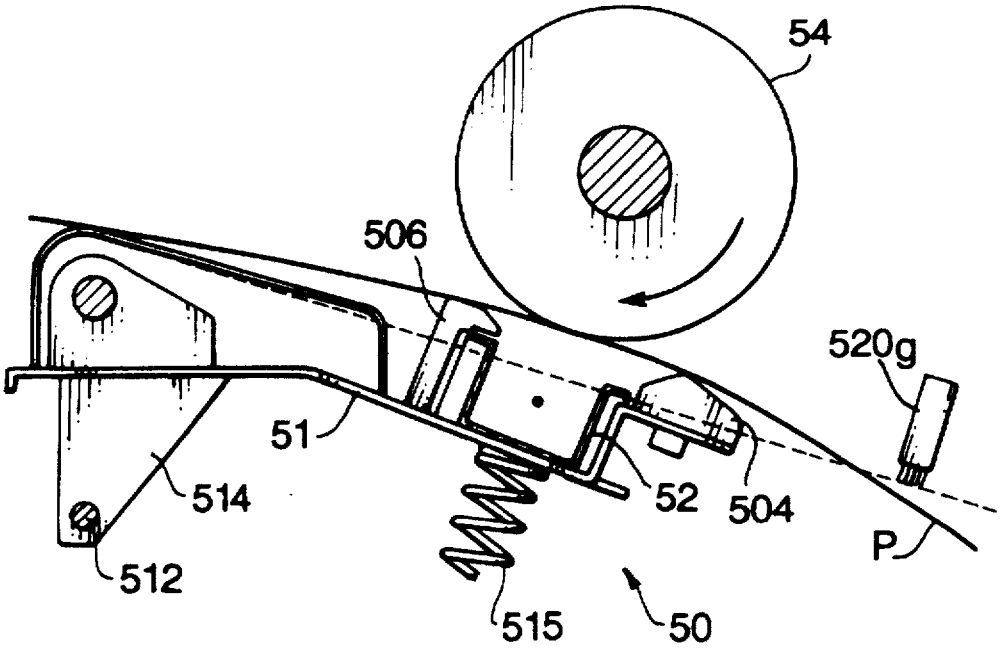
FIG. 8B is a side schematic view of an image transfer area, showing a sixth embodiment of the invention.

FIG. 8B shows a sixth embodiment of a charge removing device according to the invention. The sixth embodiment is structurally similar to the first embodiment of the invention (shown in FIG. 3) as previously described, except for the position of the charge removing brush. In the sixth embodiment of the invention, a charge removing brush 520*g* is provided upstream of the transfer unit 50 and on the printed image side of the sheet transport path. As shown in FIG. 8B, when the continuous form P is being retracted (as shown by dashed line in FIG. 8B), the paper path tends to be straight, undisturbed by the transfer unit 50. Conversely, when the continuous form P is being printed, the paper path tends to be bent by the transfer unit 50 pushing the continuous form P toward the drum 54. Accordingly, in the sixth embodiment of a charge removing device according to the invention, the charge removing brush 520*g* is placed upstream of the transfer station at a position along the sheet feeding path for contacting the continuous form P when the continuous form P is being fed in a reverse direction. However, the brush 520*g* is also arranged to be out of contact with the continuous form P when the sheet feeding path is bent by at least the transfer unit 50, and the continuous form P is being fed in a forward direction. Accordingly, when the transfer unit 50 is moved to contact the continuous form P when an image is to be printed, the continuous form P is bent by the transfer unit 50 away from the brush 520*g*, but while the continuous form P is being retracted, the transfer unit 50 is moved away from the drum 54 and away from the continuous form P, allowing the continuous form P to straighten and move into contact with the brush 520*g*. Thus, the brush 520*g* only contacts the continuous form P and removes charge when the continuous form P is being fed in a reverse direction.

It is advantageous to have the charge removing brush 520*e* contact the form P only when necessary, in order to prevent the generation of paper dust. That is, if the charge removing brush 520*e* or 520*g* contacts the continuous form P at all times, the printing quality will be adversely affected due to the paper dust generated thereby. However, the form is heated and dried at the fixing station, and also tends to be moved quickly over at least a page length in the reverse direction. Both of these factors increase the likelihood that undesired charge will be generated during the reversing operation. Accordingly, in the fifth and sixth embodiments, the charge removing brush 520*e* or 520*g* and the continuous form P only contact during reverse transport of the continuous form, when the continuous form P has is likely to become charged. During printing, the charge removing brush 520*e* or 520*g* do not contact the continuous form P, in order to prevent the generation of paper dust.

Figure 9A:
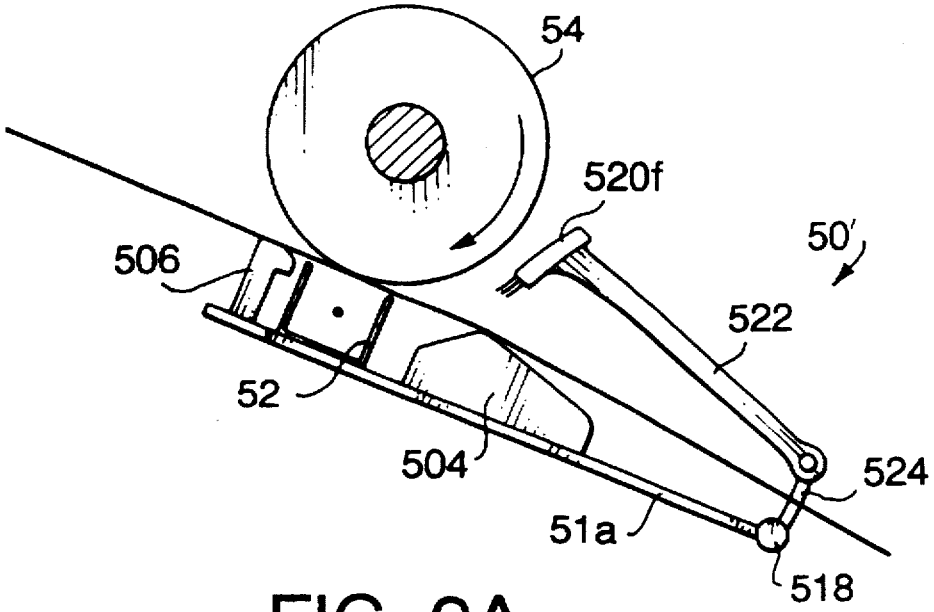
FIG. 9A is a side schematic view of an image transfer area, showing a seventh embodiment of the invention in a first position.
Figure 9B:
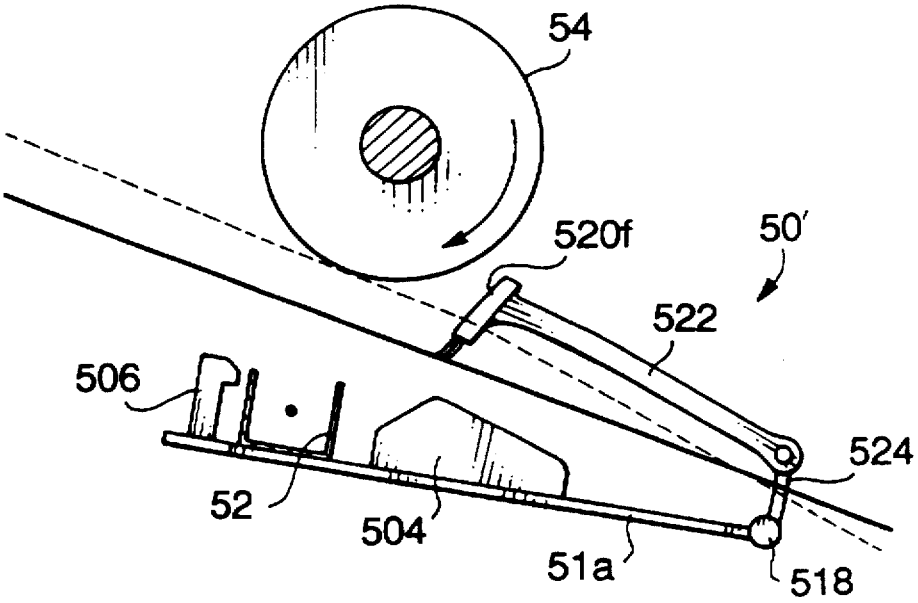
FIG. 9B is a side schematic view of an image transfer area, showing a seventh embodiment of the invention in a second position.

FIGS. 9A and 9B show side schematic views of a seventh embodiment of a charge removing device according to the invention, employing a swingable charge removing brush 520*f*. In the seventh embodiment, the charge removing brush 520*f* and the continuous form P only contact during reverse transport of the continuous form P, for the same reason as described with respect to the fifth and sixth embodiments. As shown in FIGS. 9A and 9B, in this embodiment, a swinging member 51*a* of the image transfer unit 50' is swingable about an upstream side pivot point 518. Above the swinging member 51*a*, a charge removing brush 520*f* is arranged on a supporting member 522 and an arm member 524 that are swung as a unit with the swinging member 51*a*. The charge removing brush 520*f* swings about the pivot point 518 in response to the swinging of the swingable member 51*a*. During printing, the swinging member 51*a* is in the condition shown in FIG. 9A, where the charge removing brush 520*f* and continuous form P are separated.

When the continuous form is reversed along the transport path (as shown in FIG. 9B), the swinging member 51*a* is swung in a direction away from the drum 54 and away from the form P. Simultaneously, the charge removing brush 520*f* is swung to contact the continuous form P, and prevents the form P from contacting the drum 54. Accordingly, in the seventh embodiment, when the form P is reversed along the transport path, the charge is removed from the form P by the brush 520f, and prevents the contact of the continuous form P to the drum 54 during reverse paper transport.

As described above, according to the embodiments of a charge removing device according to the invention, a charge removing brush or conductor is provided on the upstream side of the image transfer station. Electric charges on the continuous form P generated by contact with guides along the sheet transport path are discharged just prior to the image transfer area, and improper image transfer due to accumulated charge on the form is prevented.

The present disclosure relates to subject matter contained in Japanese Patent Application No. HEI 07-091675, filed on Mar. 24, 1995, which is expressly incorporated herein by reference in its entirety.

What is claimed is:

1. A charge removing device for a continuous form electrophotographic printer, comprising:

an image transfer system which electrically transfers a toner image formed on a photoconductive member onto the continuous form;

a fixing system which fixes the toner image onto the continuous form;

a feeding system which feeds the continuous form in forward and reverse directions along a transport path;

a charge removing system which removes charges accumulated on the continuous form, said charge removing system being arranged along said transport path upstream of an image transfer area in which said toner image is transferred to the continuous form by said image transfer means; and said charge removing system only contacting said continuous form to remove charge therefrom when said continuous form is fed in said reverse direction.

2. The charge removing device according to claim 1, wherein said charge removing system comprises a charge removing brush consisting of a plurality of electrically conductive brushes contacting a surface of the continuous form, and arranged across an entire width of the continuous form.

3. The charge removing device according to claim 2, wherein said charge removing brush comprises a guide system for leading the continuous form to said image transfer system, and wherein said charge removing brush is arranged at an opposing side of said image transfer system with respect to said fixing system.

4. The charge removing device according to claim 2, further comprising:

a guide member for leading the continuous form to said image transfer system, on an opposing side of said image transfer system with respect to said fixing system, said charge removing brush being fixed to an upstream side along said transport path of said guide member, and a front end of said charge removing brush contacting the continuous form at a peak of said guide member.

5. The charge removing device according to claim 4, wherein said guide member is formed from an electrically conductive material and is grounded.

6. The charge removing device according to claim 2, wherein said charge removing brush is movable relative to the continuous form and is arranged on the upstream side of said image transfer system along said transport path.

7. The charge removing device according to claim 6, wherein said charge removing brush removes charges by contacting a surface of the continuous form on a printed side of the continuous form.

8. The charge removing device according to claim 7, further comprising:

brush removing system for moving said charge removing brush and contacting said charge removing brush to the continuous form when the continuous form is fed in a reverse direction, and for retracting said charge removing brush away from the continuous form when the continuous form is fed in a forward direction.

9. The charge removing device according to claim 8, further comprising:

a swinging system which swings said transfer system toward and away from the continuous form about a pivot upstream along said transport path of said image transfer means; and a form contacting member provided to said transfer system which bends the continuous form away from the charge removing brush when the continuous form is fed in said forward direction, and for allowing the continuous form to move toward and contact the charge removing brush when the continuous form is fed in said reverse direction.

10. The charge removing device according to claim 8, further comprising:

a swinging system for swinging said transfer system toward and away from the continuous form about a pivot, said brush moving system moving said charge removing brush in cooperation with said swinging system.

11. The charge removing device according to claim 10, wherein said brush moving system comprises a brush swinging mechanism for swinging said charge removing brush toward and away from the continuous form.

12. The charge removing device according to claim 11, wherein said swinging system is provided with a pivot upstream of said transfer system about which said transfer system is swung.

13. The charge removing device according to claim 1, wherein the continuous form proceeds along said transport path directly from said charge removing system to said image transfer area without contacting any member after charges are removed.

14. The charge removing device according to claim 1, wherein the continuous form is always heated by passing through said fixing system before being fed in a reverse direction.

* * * * *